US007878015B2

(12) United States Patent
Lim et al.

(10) Patent No.: US 7,878,015 B2
(45) **Date of Patent: *Feb. 1, 2011**

(54) RADIATING APPARATUS OF BUILT-IN REFRIGERATOR

(75) Inventors: Hyoung Keun Lim, Suwon-si (KR); Youn Seok Lee, Goyang-si (KR); Yang Gyu Kim, Seoul (KR); Se Young Kim, Seoul (KR); Chan Ho Chun, Seoul (KR)

(73) Assignee: LG Electronics Inc., Seoul (KR)

( * ) Notice: Subject to any disclaimer, the term of this patent is extended or adjusted under 35 U.S.C. 154(b) by 1044 days.

This patent is subject to a terminal disclaimer.

(21) Appl. No.: 10/960,107

(22) Filed: Oct. 8, 2004

(65) Prior Publication Data

US 2005/0115272 A1 Jun. 2, 2005

(30) Foreign Application Priority Data

Dec. 1, 2003 (KR) ..... 10-2003-0086307

(51) Int. Cl.
*F25D 23/12* (2006.01)

(52) U.S. Cl. ..... 62/259.1; 62/498

(58) Field of Classification Search ..... 62/428, 62/452, 455–457, 507, 314, 411, 414, 457.3, 62/440, 453, 298, 259.1, 498
See application file for complete search history.

(56) References Cited

U.S. PATENT DOCUMENTS

| | | | | |
|---|---|---|---|---|
| 2,037,782 | A * | 4/1936 | Hainsworth | 62/485 |
| 3,330,131 | A * | 7/1967 | Papst | 62/455 |
| 3,401,534 | A * | 9/1968 | Marsteller | 62/280 |
| 3,714,795 | A * | 2/1973 | Fowell et al. | 62/508 |
| 3,736,765 | A * | 6/1973 | O'Dell | 62/127 |
| 3,736,768 | A * | 6/1973 | Harbour et al. | 62/455 |
| 4,490,990 | A * | 1/1985 | Chastine et al. | 62/279 |
| 5,347,827 | A * | 9/1994 | Rudick et al. | 62/440 |
| 5,542,263 | A * | 8/1996 | Choi et al. | 62/262 |
| 6,666,045 | B1 * | 12/2003 | Song | 62/441 |
| 6,766,655 | B1 * | 7/2004 | Wu | 62/305 |
| 6,925,836 | B2 * | 8/2005 | Chung et al. | 62/507 |
| 6,955,064 | B2 * | 10/2005 | Lee et al. | 62/453 |

FOREIGN PATENT DOCUMENTS

| | | | |
|---|---|---|---|
| CN | 2307485 | Y | 2/1999 |
| EP | 0718570 | A2 * | 6/1996 |
| JP | 56-82480 | U | 7/1981 |
| JP | 3-261408 | A | 11/1991 |

(Continued)

OTHER PUBLICATIONS

Abstract to EP 0178570 A2 to Mrzyglod Matthias.*

(Continued)

*Primary Examiner*—Mohammad M Ali
(74) *Attorney, Agent, or Firm*—Birch, Stewart, Kolasch & Birch, LLP

(57) ABSTRACT

A radiating apparatus of a built-in refrigerator includes an airflow guide that separates a condenser from a blower fan in order to prevent a cool air and a hot air from mixing together, thereby increasing an efficiency of the built-in refrigerator.

29 Claims, 7 Drawing Sheets

FOREIGN PATENT DOCUMENTS

| | | | |
|---|---|---|---|
| JP | 5-172453 | A | 7/1993 |
| JP | 07-167547 | A | 7/1995 |
| JP | 8-240375 | A | 9/1996 |
| JP | 08-247620 | A | 9/1996 |
| JP | 11-230662 | A | 8/1999 |
| JP | 2003-214658 | A * | 7/2003 |

OTHER PUBLICATIONS

Translation to EP 0718570 A2 to Mrzyglod Matthias.*

Japanese Application No. 54-165850 filed Nov. 29, 1979(Corresponds to JP-56-82480-U).

* cited by examiner

RADIATING APPARATUS OF BUILT-IN REFRIGERATOR

This Nonprovisional application claims priority under 35 U.S.C. §119(a) on Patent Application No(s). 10-2003-0086307 filed in Korea, Republic of on Dec. 1, 2003, the entire contents of which are hereby incorporated by reference.

BACKGROUND OF THE INVENTION

1. Field of the Invention

The present invention relates to a radiating apparatus of a built-in refrigerator, and more particularly, to a radiating apparatus of a built-in refrigerator that has a less pneumatic resistance for an efficient flow of a cooling air.

2. Description of the Related Art

A refrigerator is a kitchen appliance in which foods can be stored at a low temperatures in order to freshly store the foods for a long time. The refrigerator largely includes a main body in which food storage room is located and a machine room in which refrigeration cycle is performed for cooling.

Since the refrigerator inevitably has a certain amount of volume, it sticks out from a wall when installed at a kitchen or a living room. This is not good for a space saving as well as a beautiful appearance.

To solve the above problem, there is provided a built-in refrigerator that is installed in a cabinet or a sink, looking to be an integral part of the kitchen or the living room.

The built-in refrigerator includes a main body having a food storage room and a machine room in which a refrigerant circulates for keeping the food storage room cool.

Because of an installation condition of the built-in refrigerator as mentioned above, there is a disadvantage in circulating an air through the machine room for heat exchange. Therefore, the heat exchange efficiency and a discharge of the air after the heat exchange are increasing concerns of the related art built-in refrigerator.

FIG. 1 is a schematic sectional view illustrating a built-in refrigerator of the related art.

Referring to FIG. 1, a built-in cabinet 10 includes a refrigerator main body 11 installed therein, a baseboard 14 disposed at a bottom of a front side thereof, a machine room 15 disposed at a bottom of a rear side of the refrigerator main body 11, and a support board 13 supporting the refrigerator main body 11.

The built-in cabinet 10 also includes an air-introducing hole 21 formed in the baseboard 14, a suction passage 18 communicating with the air-introducing hole 21, and an air discharge passage 19 located at a rear side of the refrigerator main body 11. The suction passage 18 and the air discharge passage 19 together constitute a radiation passage.

The refrigerator main body 11 is installed within an inner space of the built-in cabinet. Particularly, the refrigerator main body 11 is mounted on the support board 13 and between a front door panel 12 and a back wall 17. The baseboard 14 is installed to block external dirt and for a beauty purpose.

The machine room 15 is protected using a back cover 16, and it induces and discharges an ambient air.

The ambient air is introduced at the air-introducing hole 21 that is disposed at a bottom of the font side of the built-in cabinet 10. The introduced air flows along the suction passage 18 that is disposed in a bottom of the built-in cabinet 10. After circulating the machine room 15, the introduced air is discharged along the air discharge passage 19.

FIG. 2 is a front view illustrating a structure of the machine room 15 of the built-in refrigerator of the related art.

Referring to FIG. 2, the machine room 15 is disposed at a bottom of a rear side of the refrigerator main body 11. The machine room 15 includes a compressor 23 stably mounted in a predetermined portion thereof for compressing a refrigerant, a condenser 24 in which heat is exchanged between the refrigerant and the introduced ambient air, and a blower fan 25 mounted at a front and/or a back of the condenser 24 for inducing the introduced ambient air.

The back cover 16 is attached on a back of the machine room 15 in order to protect parts disposed in the machine room 15 from an external impact, and to provide an air passage therethrough. The back cover 16 is formed with inlet holes 20 in order to induce the ambient air when the blower fan 25 is driven, outlet holes 22 in order to draw off the introduced ambient air.

When the blower fan 25 is driven, the ambient air is introduced into the machine room 15 through the inlet holes 20 of the back cover 16. The introduced ambient air is discharged through the outlet holes 22 of the back cover 16 after exchanging heat with the condenser 24 and the compressor 23. The discharged air from the machine room 15 flows through the air discharge passage 19 to an outside of the built-in cabinet, simultaneously another ambient air being introduced from the suction passage 18 to the machine room 15.

However, since the blower fan 25 of the related art is an axial flow fan, it induces an air in an axial direction and discharges the air in the same direction. Therefore, there is a drawback in that the condenser 24 must be disposed at a front or a rear of the blower fan 25.

In other words, though the related art machine room of the built-in refrigerator has a small volume, it is provided with the axial flow fan that induces and discharges the ambient air in the same axial direction. Therefore, it is difficult for the related art built-in refrigerator to form an efficient air-flowing channel.

SUMMARY OF THE INVENTION

Accordingly, the present invention is directed to a radiating apparatus of a built-in refrigerator that substantially obviates one or more problems due to limitations and disadvantages of the related art.

An object of the present invention is to provide a radiating apparatus of a built-in refrigerator that has a machine room having an improved structure such that an air flows therethrough with a low resistance, thereby attaining an efficient radiating.

Another object of the present invention is to provide a radiating apparatus of a built-in refrigerator in which a machine room is divided into a compressor section having a compressor and a condenser section having a condenser, the machine room being modified to have low pneumatic resistance, thereby increasing a radiating efficiency.

A further another object of the present invention is to provide a radiating apparatus of a built-in refrigerator that has an airflow guide curved upwardly for discharging an air upwardly from the machine room.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a radiating apparatus of a built-in refrigerator including: a refrigerator main body installed in a built-in cabinet; a machine room disposed at one side of the refrigerator main body, the machine room including a compressor for compressing a refrigerant, a condenser for exchanging heat between the refrigerant that has passed the compressor, and an air, a blower fan for forcing the air to flow, and an airflow guide for separating the condenser from the blower fan; and a back cover for protecting a back side of the machine room.

In an aspect of the present invention, there is provided a radiating apparatus of a built-in refrigerator comprising: a refrigerator main body installed in a built-in cabinet; a machine room positioned at a predetermined portion of a rear side of the refrigerator main body; a condenser disposed at an inner predetermined portion of the machine room; a blower fan installed above the condenser, for inhaling ambient air; an airflow guide for partitioning the condenser and the blower fan into an upper side and a lower side; and a support board disposed on a bottom of the refrigerator main body, for supporting the refrigerator main body.

In another aspect of the present invention, there is provided a radiating apparatus of a built-in refrigerator comprising: a machine room including a compressor section in which a compressor is accommodated and a condenser section in which a condenser in which a refrigerant that passes through the compressor exchanges heat with air is accommodated; a blower fan for introducing the air into the machine room; a vertical barrier for partitioning the machine room into the compressor section and the condenser section; and an airflow guide horizontally formed between the condenser and the blower fan, the airflow guide having one edge curved upward.

In another aspect of the present invention, there is provided a radiating apparatus of a built-in refrigerator comprising: a compressor for compressing a refrigerant; a condenser for condensing the compressed refrigerant; a cross flow fan disposed above the condenser, for inhaling an ambient air; and an airflow guide formed between the condenser and the cross flow fan.

According to the inventive machine room of the built-in refrigerator, the machine room is partitioned into an upper and an lower portions by an airflow guide, and an ambient air communicates between the upper portion and the lower portion, thereby separating inflow and outflow and increasing an heat exchange efficiency.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
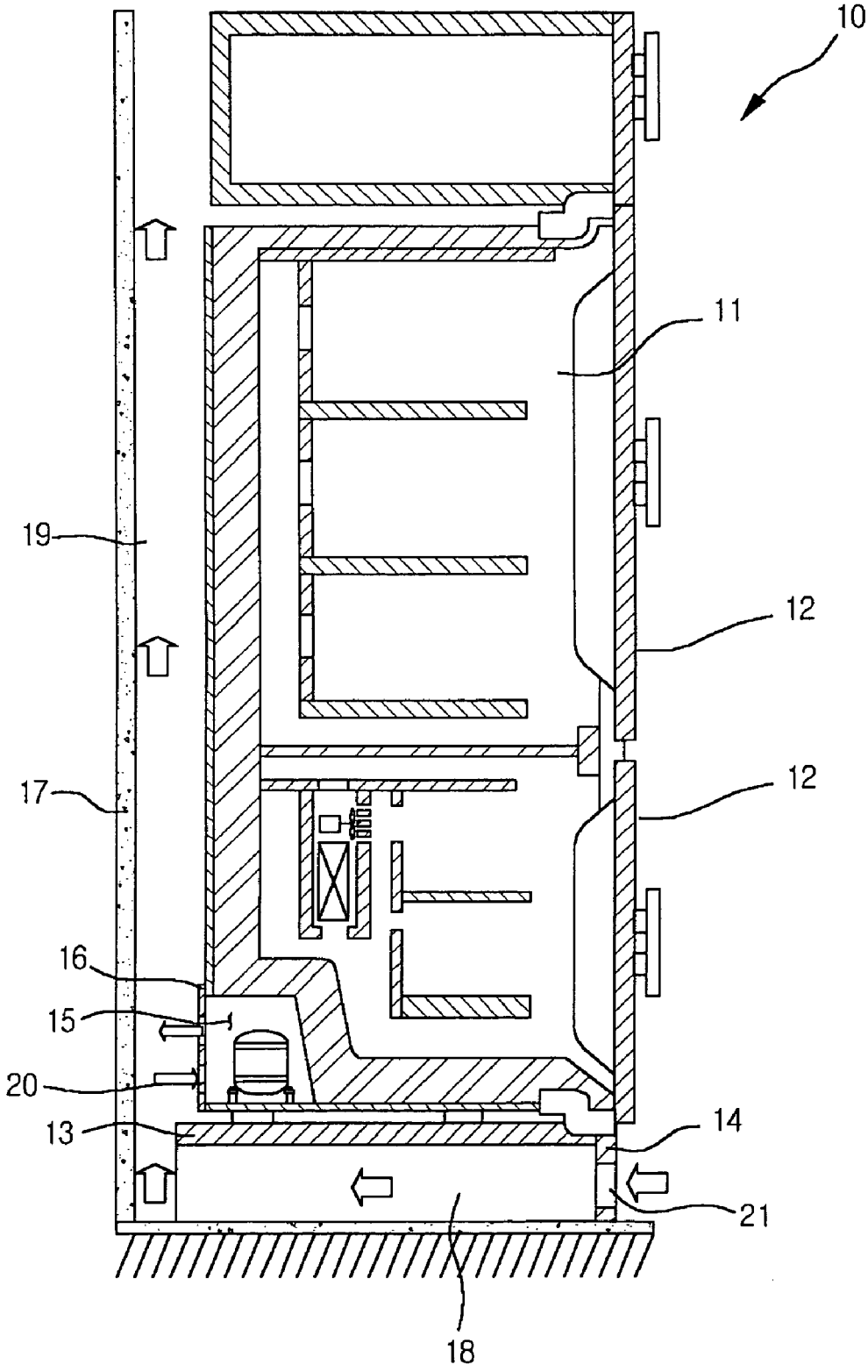
Fig.1 Related Art
FIG. 1 is a schematic sectional view illustrating a built-in refrigerator of the related art.
Figure 2:
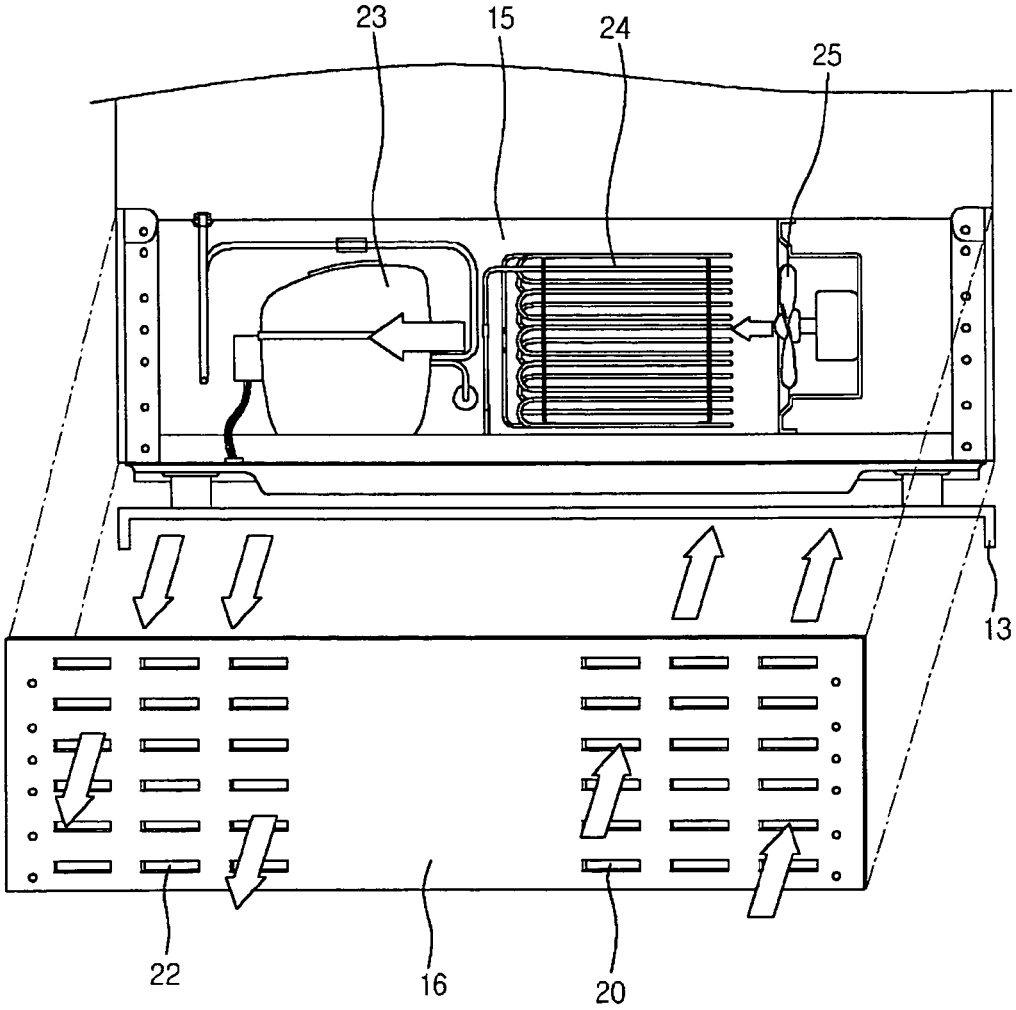
Fig.2 Related Art
FIG. 2 is a front view illustrating a structure of a machine room of a built-in refrigerator of the related art.
Figure 3:
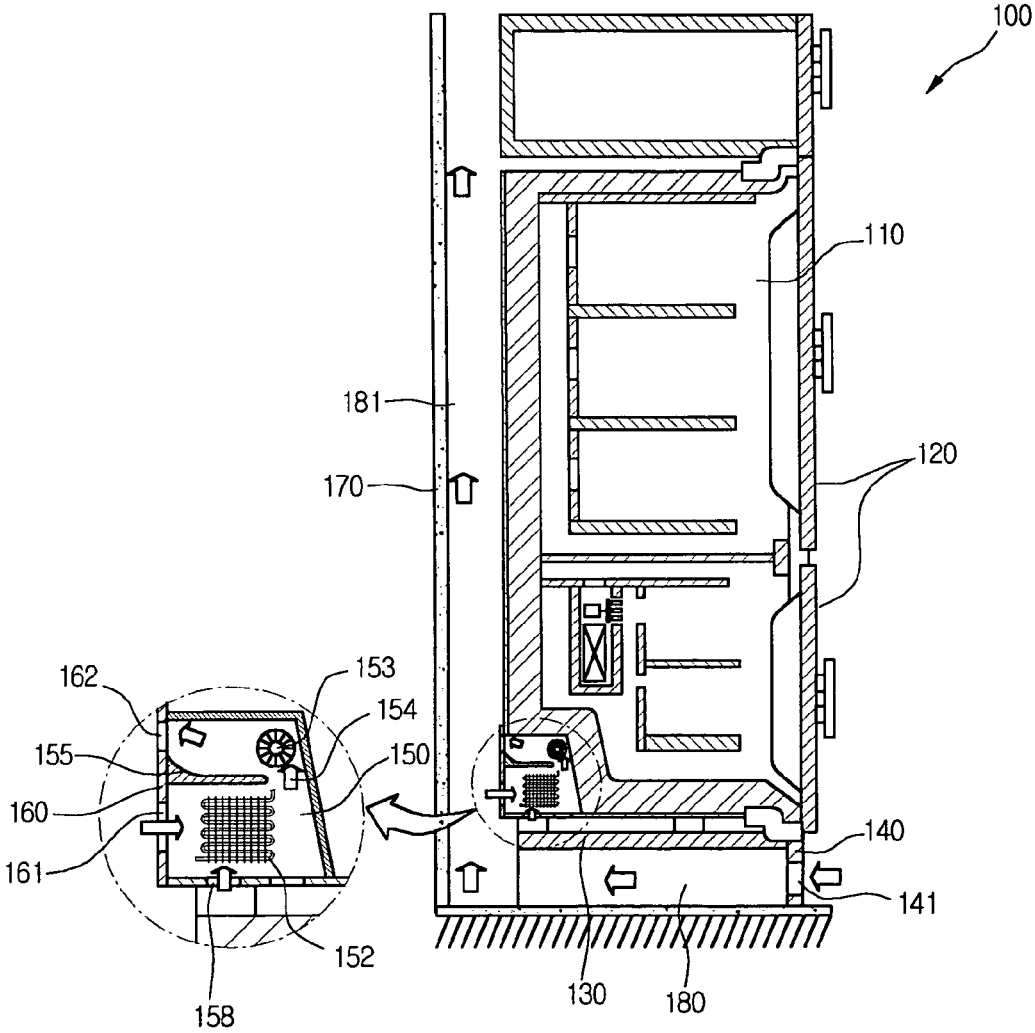
FIG. 3 is a schematic sectional view illustrating a structure of a radiating apparatus of a built-in refrigerator according to the present invention.
Figure 4:
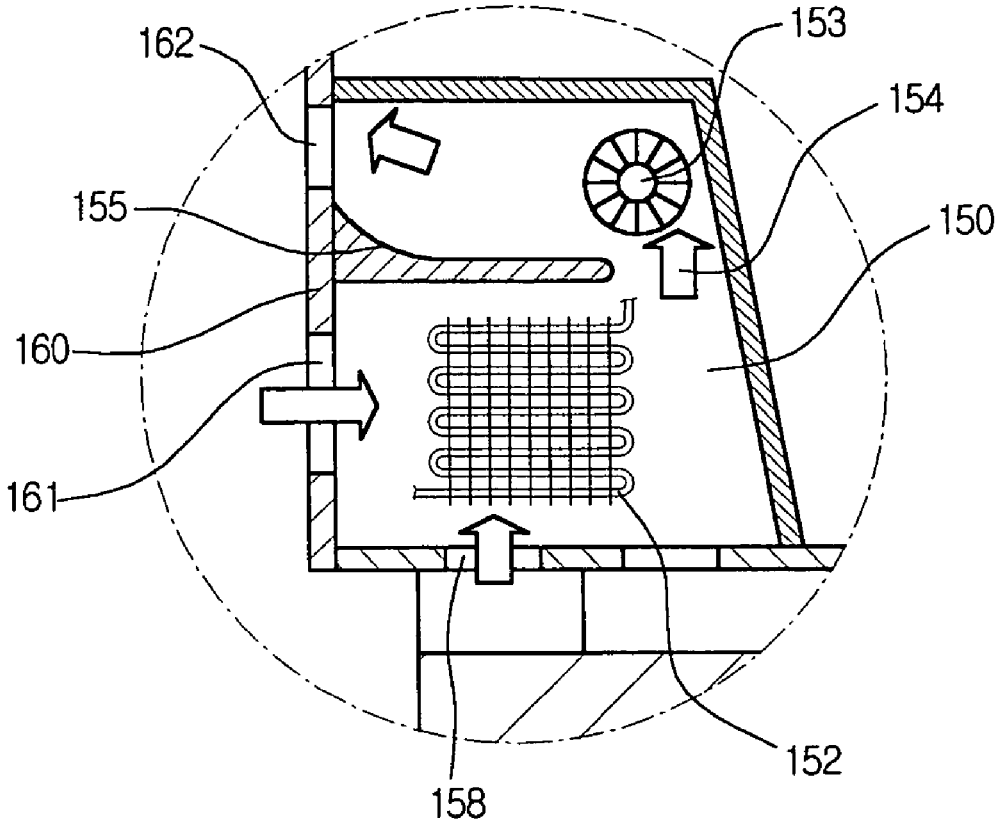
FIG. 4 is an enlarged sectional view of a machine room depicted within a circle of FIG. 3.
Figure 5:
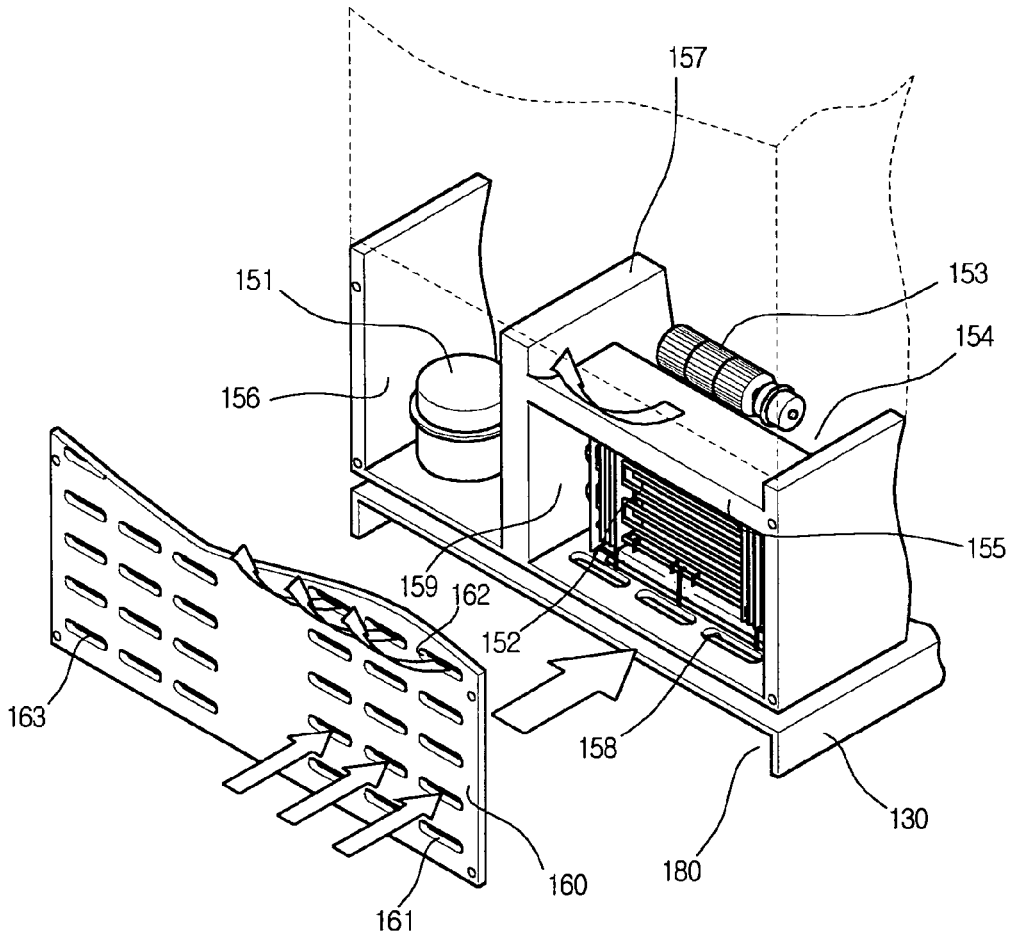
FIG. 5 is a perspective view of a machine room depicted in FIG. 4.

FIG. 3 is a schematic sectional view illustrating a structure of a radiating apparatus of a built-in refrigerator according to the present invention, FIG. 4 is an enlarged sectional view of a machine room depicted within a circle of FIG. 3, and FIG. 5 is a perspective view of the machine room depicted in FIG. 4.

Referring to FIGS. 3 through 5, a built-in cabinet 100 includes a refrigerator main body 110 installed therein, door panels 120 provided at a front side of the refrigerator main body 110, a support board 130 formed horizontally at a lower side of the main body 110, for supporting the refrigerator main body 110, and a baseboard 140 disposed at a front side of the support board 130.

The built-in cabinet 100 also includes a machine room 150 installed at a lower side of a rear side of the refrigerator main body 110 and a radiation passage configured to exchange heat generated from the machine room 150 with outdoor air.

In detail, the radiation passage includes an air-introducing hole 141 formed at a lower portion of the baseboard 140, a suction passage 180 for guiding the air inhaled through the air-introducing hole 141 to the machine room 150, and an air discharge passage 181 vertically formed at a rear side of the refrigerator main body 110 such that the air inhaled into the machine room 150 through the suction passage 180 is heat-exchanged and then discharged.

In more detail, the air discharge passage 181 is vertically formed between the rear side of the refrigerator main body 110 and a rear wall 170 of the built-in cabinet 100.

The machine room 150 is divided into a compressor section 156 and a condenser section 159. The compressor section 156 is provided with a compressor 151 stably mounted therein. The condenser section 159 is provided with a condenser 152 in which the ambient air exchanges heat with a refrigerant, and a blower fan 153 stably mounted above the condenser 152, for inhaling the ambient air. The machine room 150 further includes an airflow guide 155 separating the condenser 152 from the blower fan 153.

A back cover 160 having a board shape is attached on an opened back of the machine room 150 and protects an inside of the machine room 150. The back cover 160 is screwed to a rear side of the refrigerator main body 110. The back cover 160 is formed with a plurality of air holes 161, 162, and 163 such that the ambient air passes therethrough.

In detail, the air holes include one or more condenser inlet holes 161, one or more condenser outlet holes 162, and one or more compressor inlet/outlet holes 163. The condenser inlet holes 161 allow the ambient air introduced along the suction passage 180 to be again introduced into the condenser section 159 by the blower fan 153. The condenser outlet holes 162 allow the ambient air introduced into the condenser inlet holes 161 to exchange heat with the condenser 152 and then to be discharged through the air discharge passage 181. The compressor inlet/outlet holes 163 allow the ambient air to be introduced into or to be discharged from the compressor section 156. It will be apparent that shapes and numbers of the air holes 161, 162, and 163 are not restricted to the embodiment of the present invention and all possible ways that flow resistance is minimized while the ambient air is introduced into and discharged from the machine room can be provided.

The blower fan 153 may be a cross flow fan that allows an air introduced thereinto to be discharged at a right angle. The airflow guide 155 is formed above the condenser 152 to partition the condenser section 159 into two parts.

In detail, the airflow guide 155 is disposed between the condenser inlet holes 161 and the condenser outlet holes 162 and is rounded upward at a predetermined curvature from one edge adjacent to the blower fan 153 toward the other edge neighboring the back cover 160, such that the ambient air discharged from the blower fan 153 flows upwardly through the condenser outlet holes 162.

Thus, since the airflow guide 155 has one edge rounded upward, it is prevented that the ambient air discharged through the condenser outlet holes 162 flows back to the machine room 150 through the condenser inlet holes 161.

An overall flow of the ambient air through the radiating apparatus of the present invention will now be described more fully with reference to the accompanying drawings.

An ambient air inhaled through the air-introducing hole 141 flows along the suction passage 180. The air flows into the condenser section 159 through condenser bottom inlet holes 158 and the condenser inlet holes 161, and the compressor section 156 through the compressor inlet/outlet holes 163.

The air flowed into the condenser section 159 exchanges heat with the condenser 152 and is then forced to flow through a rear opening 154 by the blower fan 153. The forcibly flowing air flows upward along the rear opening 154, flows upward along an upward curve of the airflow guide 155 and is then discharged through the condenser outlet holes 162 such that the air having a high temperature goes to an outside along the air discharge passage 181.

Figure 6:
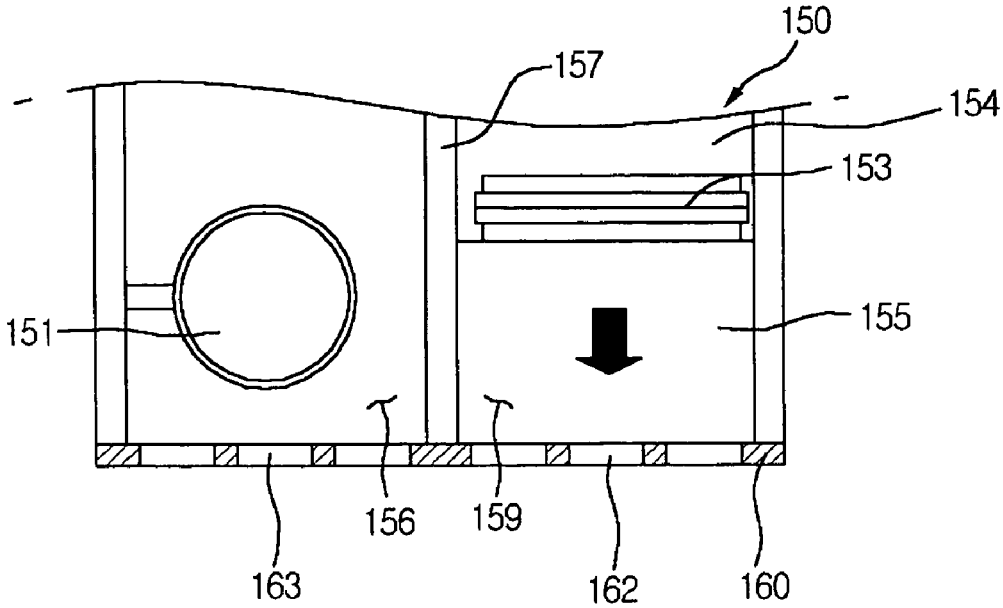
FIG. 6 is a plan view illustrating a flow of an air that passes through a machine room according to the present invention.
Figure 7:
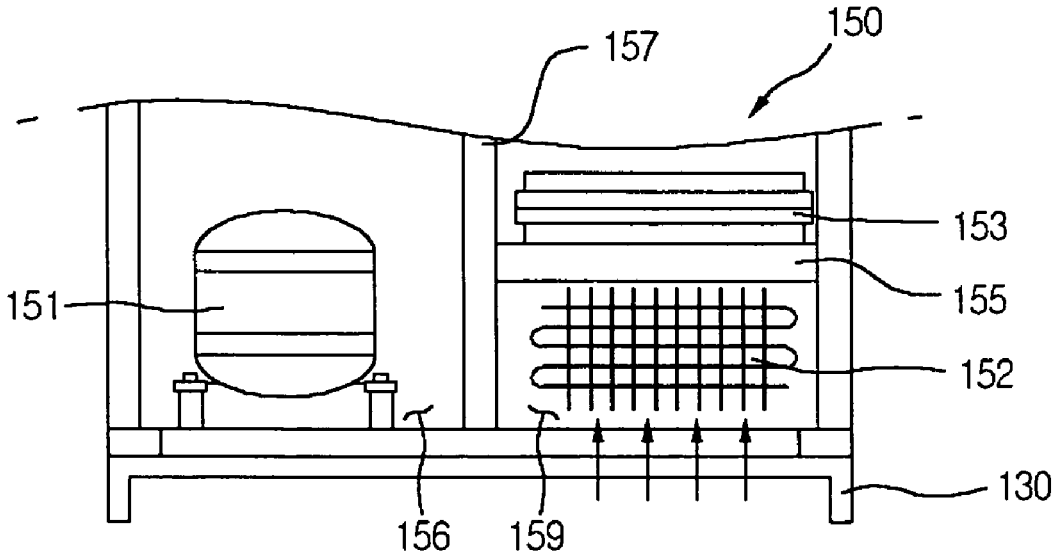
FIG. 7 is a front view illustrating a flow of an air that passes through a machine room according to the present invention.

FIGS. 6 and 7 are a plan view and a front view illustrating a flow of an air that passes through a machine room according to the present invention.

Referring to FIGS. 6 and 7, the machine room 150 is divided into the compressor section 156 and the condenser section 159 by a vertical barrier 157. The compressor section 156 is provided with the compressor 210. The condenser section 159 is provided with the condenser 152 at a lower portion and the blower fan 153 at an upper portion.

The airflow guide 155 is horizontally installed between the condenser 152 and the blower fan 153 such that the condenser 152 positioned at a lower side and the blower fan 153 positioned at an upper side form a multi-layer structure. The airflow guide 155 is perpendicularly secured to the vertical barrier 157 and is formed with the rear opening 154 such that the air that has passed through the condenser 152 can flow upward by an inhaling force of the blower fan 153.

The airflow guide 155 may be integrally formed with the vertical barrier 157 by an injection molding. Also, the airflow guide 155 may be constructed such that one edge thereof is in contact with the vertical barrier 157, the other edge is in contact with a wall of the machine room 150, and the one edge and the other edge are coupled by a coupling member.

The machine room 150 is provided at a bottom thereof with the condenser bottom inlet holes 158. The number of the condenser bottom hole 158 is at least one.

The overall flow of the ambient air described above will now be described with respective to an operation of the blower fan 153.

When the blower fan 153 is driven, an ambient air is introduced into the machine room 150 through the condenser bottom inlet holes 158 and the condenser inlet holes 161. The introduced air exchanges heat with the condenser 152 and then is forced to flow through the rear opening 154 toward the blower fan 153. After passing through the blower fan 153, the air is discharged along the upward curve of the airflow guide 155 formed between the condenser 152 and the blower fan 153.

The airflow guide 155 guides the air discharged from the blower fan 153 in an upward direction as well as the air introduced from the low-positioned condenser 152. Therefore, the discharged air is injected upward along the air discharge passage 181 formed between the rear side of the refrigerator main body 110 and the wall 170, so that the air easily goes to an outside along the air discharge passage 181.

The rear opening 154 formed at the rear of the airflow guide 155 provides a passage for the air to flow from the condenser inlet holes 161 to the blower fan 153, connecting the lower portion with the upper portion of the condenser section 159.

The airflow guide 155 has a curved shape for the air to be discharged upwardly. According to a preferred embodiment, the curved shape may be an upwardly curved "L" shape, and also a "T" or "Y" shape having a curve on each side of the airflow guide 155.

If the built-in refrigerator installed in the built-in cabinet is powered on, each part disposed in the machine room 150 installed at the rear of the refrigerator main body 110 starts to operate.

The compressor 210 disposed in the machine room 150 compresses a refrigerant at a high temperature and a high pressure. The compressed refrigerant flows through the condenser for exchanging heat with the air such that the refrigerant cools down at a low temperature and a high pressure.

As the blower fan 153 operates, the ambient air is introduced into the condenser section 159 through the bottom inlet holes 158 and the condenser inlet holes 161 and exchanges heat with the refrigerant flowing in the condenser 152.

The airflow guide 155 may be secured to each side and rear side of the machine room 150 in order to guide the inflow and outflow of the air without the vertical barrier 157 that divides the machine room 150.

Though the airflow guide 155 is horizontally installed within the machine room, it may extend to the wall 170 that is spaced out a predetermined distance apart from the refrigerator main body 110.

As described above, the machine room 150 of the built-in refrigerator of the present invention includes the airflow guide 155 that horizontally partitions the machine room into the upper and the lower portions and defines the rear opening 154 between the upper and the lower portions, so that separates the inducing airflow from the discharging airflow in order to increase the heat exchange efficiency.

The blower fan 153 may be a Sirocco fan or a turbo fan for inducing and discharging the air in a wanted direction so that the efficient heat exchange can be attained.

Further, the condenser is disposed at the lower portion of the machine room 150 and the blower fan 153 is disposed at the upper portion of the machine room 150 in order to prevent the discharged air from flowing back, thereby maximizing the heat exchange efficiency.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A radiating apparatus of a built-in refrigerator comprising:

a refrigerator main body installed in a built-in cabinet;

a machine room including a compressor for compressing a refrigerant, a condenser for exchanging heat between the refrigerant that has passed the compressor and an air, a blower fan for forcing the air to flow, and an airflow guide for separating the condenser from the blower fan, wherein the airflow guide is located above the condenser and below the blower fan, and at least a same partial portion of the airflow guide is located directly above the condenser and directly below the blower fan;

a back cover for protecting a back side of the machine room; and a vertical barrier for preventing any air drawn by the blower fan from directly entering into a space where the compressor is located, wherein the condenser exchanges heat between the refrigerant that has passed the compressor and the air that is inhaled into the machine room or discharged from the machine room by the blower fan, and wherein the airflow guide has a top surface, the top surface of the airflow guide including:

an upwardly curved top surface ending at a first end of the airflow guide; and a substantially flat top surface extending from the upwardly curved top surface toward a second end of the airflow guide opposite to the first end of the airflow guide, wherein a third end of the airflow guide between the first and second ends of the airflow guide is in contact with the vertical barrier such that the upwardly curved top surface joins the vertical barrier at the third end of the airflow guide.

2. The radiating apparatus of claim 1, further comprising a radiation passage, which includes an air-introducing hole formed at a bottom of a front side of the refrigerator main body, a suction passage along which the air that has passed through the air-introducing hole flows, and an air discharge passage along which the air that enters the machine room through the suction passage is discharged.

3. The radiating apparatus of claim 1, wherein the back cover comprises an inlet hole through which the air is introduced into the machine room.

4. The radiating apparatus of claim 1, wherein the back cover comprises an outlet hole through which the air having a high temperature is discharged from the machine room to an outside.

5. The radiating apparatus of claim 1, wherein the back cover comprises an inlet hole through which the air is introduced into the space where the compressor is located.

6. The radiating apparatus of claim 1, wherein the air of the machine room is discharged upwardly along and above the upwardly curved top surface of the airflow guide.

7. The radiating apparatus of claim 1, wherein the blower fan is a cross flow fan in which an air introducing direction and an air discharging direction form a predetermined angle.

8. The radiating apparatus of claim 1, wherein the machine room is provided at a bottom thereof with at least one inlet hole through which the air is introduced.

9. The radiating apparatus of claim 1, wherein the vertical barrier is structurally configured to prevent the blower fan from directly drawing any air inside the space where the compressor is located.

10. The radiating apparatus of claim 1, wherein the airflow guide has a substantially flat bottom surface, the substantially flat top surface and the substantially flat bottom surface joining the vertical barrier at the third end of the airflow guide.

11. The radiating apparatus of claim 1, wherein the second end of the airflow guide is closer to the blower fan than the first end of the airflow guide.

12. A radiating apparatus of a built-in refrigerator comprising:

a refrigerator main body installed in a built-in cabinet;

a machine room positioned at a predetermined portion of a rear side of the refrigerator main body;

a condenser disposed at an inner predetermined portion of the machine room;

a blower fan installed above the condenser, for inhaling ambient air;

an airflow guide for partitioning the condenser and the blower fan into an upper side and a lower side, wherein the airflow guide is located above the condenser and below the blower fan, and at least a same partial portion of the airflow guide is located directly above the condenser and directly below the blower fan;

a support board disposed on a bottom of the refrigerator main body, for supporting the refrigerator main body; and a vertical barrier for partitioning the machine room into a condenser section in which the condenser is accommodated and a compressor section in which the compressor is accommodated spacing away by a predetermined distance from the condenser, wherein the airflow guide separates the air that is inhaled into the machine room and discharged from the machine room by the blower fan, and the air that is inhaled into the machine room or discharged from the machine room radiates heat of the condenser, and wherein the vertical barrier prevents any air drawn by the blower fan from directly entering into the compressor section, and wherein the airflow guide has a top surface, the top surface of the airflow guide including:

an upwardly curved top surface ending at a first end of the airflow guide; and a substantially flat top surface extending from the upwardly curved top surface toward a second end of the airflow guide opposite to the first end of the airflow guide, wherein a third end of the airflow guide between the first and second ends of the airflow guide is in contact with the vertical barrier such that the upwardly curved top surface joins the vertical barrier at the third end of the airflow guide.

13. The radiating apparatus of claim 12, wherein the support board comprises an air-introducing hole formed in a lower front side of the support board at a predetermined size, through which the ambient air is introduced, and a suction passage horizontally formed below the support board, through which the ambient air introduced through the air-introducing hole is transferred to a rear side of the refrigerator main body.

14. The radiating apparatus of claim 12, wherein there is a gap between the airflow guide and the refrigerator main body, which allows the heat-exchanged ambient air to flow through the gap toward the blower fan, and wherein the gap is located directly below the blower fan.

15. The radiating apparatus of claim 12, wherein the machine room comprises a back cover screwed to a back side of the machine room to seal the back side of the machine room, the back cover having a plurality of through holes through which the ambient air enters or goes to an outside.

16. The radiating apparatus of claim 12, wherein the vertical barrier and the airflow guide are integrally formed.

17. The radiating apparatus of claim 12, wherein one edge of the airflow guide is in contact with the vertical barrier, the other edge is in contact with an inner wall of the machine room, and both the edges being coupled by a coupling member, for horizontally separating the condenser and the blower fan from each other.

18. The radiating apparatus of claim 12, wherein the vertical barrier is structurally configured to prevent the blower fan from directly drawing any air inside the compressor section.

19. The radiating apparatus of claim 12, wherein the airflow guide has a substantially flat bottom surface, the substantially flat top surface and the substantially flat bottom surface joining the vertical barrier at the third end of the airflow guide.

20. The radiating apparatus of claim 12, wherein the second end of the airflow guide is closer to the blower fan than the first end of the airflow guide.

21. A radiating apparatus of a built-in refrigerator comprising:

a machine room including a compressor section in which a compressor is accommodated and a condenser section in which a condenser is accommodated;

a blower fan for introducing air into the machine room;

a vertical barrier for partitioning the machine room into the compressor section and the condenser section; and an airflow guide horizontally formed between the condenser and the blower fan, wherein the airflow guide is located above the condenser and below the blower fan, at least a same partial portion of the airflow guide is located directly above the condenser and directly below the blower fan, wherein the vertical barrier prevents any air drawn by the blower fan from directly entering into the compressor section, and wherein the airflow guide has a top surface, the top surface of the airflow guide including:

an upwardly curved top surface ending at a first end of the airflow guide; and a substantially flat top surface extending from the upwardly curved top surface toward a second end of the airflow guide opposite to the first end of the airflow guide, wherein a third end of the airflow guide between the first and second ends of the airflow guide is in contact with the vertical barrier such that the upwardly curved top surface joins the vertical barrier at the third end of the airflow guide.

22. The radiating apparatus of claim 21, wherein there is a gap between the airflow guide and the refrigerator main body such that the ambient air, which exchanges heat with the condenser, rises through the gap toward the blower fan, and wherein the gap is located directly below the blower fan.

23. The radiating apparatus of claim 21, wherein the vertical barrier is structurally configured to prevent the blower fan from directly drawing any air inside the compressor section.

24. The radiating apparatus of claim 21, wherein the airflow guide has a substantially flat bottom surface, the substantially flat top surface and the substantially flat bottom surface joining the vertical barrier at the third end of the airflow guide.

25. The radiating apparatus of claim 21, wherein the second end of the airflow guide is closer to the blower fan than the first end of the airflow guide.

26. A radiating apparatus of a built-in refrigerator comprising:

a compressor for compressing a refrigerant;

a condenser for condensing the compressed refrigerant;

a cross flow fan disposed above the condenser, for inhaling an ambient air;

an airflow guide formed between the condenser and the cross flow fan, wherein the airflow guide is located above the condenser and below the blower fan, and at least a same partial portion of the airflow guide is located directly above the condenser and directly below the blower fan; and a vertical barrier for preventing any air drawn by the blower fan from directly entering into a space where the compressor is located, wherein the airflow guide separates the air that is inhaled into the machine room and discharged from the machine room by the blower fan, and the air that is inhaled into the machine room or discharged from the machine room radiates heat of the condenser, and wherein the airflow guide has a top surface, the top surface of the airflow guide including:

an upwardly curved top surface ending at a first end of the airflow guide; and a substantially flat top surface extending from the upwardly curved top surface toward a second end of the airflow guide opposite to the first end of the airflow guide, wherein a third end of the airflow guide between the first and second ends of the airflow guide is in contact with the vertical barrier such that the upwardly curved top surface joins the vertical barrier at the third end of the airflow guide.

27. The radiating apparatus of claim 26, wherein the vertical barrier is structurally configured to prevent the blower fan from directly drawing any air inside the space where the compressor is located.

28. The radiating apparatus of claim 26, wherein the airflow guide has a substantially flat bottom surface, the substantially flat top surface and the substantially flat bottom surface joining the vertical barrier at the third end of the airflow guide.

29. The radiating apparatus of claim 26, wherein the second end of the airflow guide is closer to the blower fan than the first end of the airflow guide.

* * * * *